US006199975B1

(12) United States Patent
Baitz et al.

(10) Patent No.: US 6,199,975 B1
(45) Date of Patent: Mar. 13, 2001

(54) INK FILLING DEVICE FOR AN INK JET PRINT HEAD AND INK PRINT HEAD WHICH CAN BE FILLED THEREWITH

(75) Inventors: Günter Baitz, Berlin; Joachim Burchart, Schlangen, both of (DE)

(73) Assignee: Siemens Nixdorf Informationssysteme Aktiengesellschaft, Aderborn (DE)

( * ) Notice: Subject to any disclaimer, the term of this patent is extended or adjusted under 35 U.S.C. 154(b) by 0 days.

(21) Appl. No.: 09/463,114

(22) PCT Filed: Apr. 9, 1998

(86) PCT No.: PCT/DE98/01027

§ 371 Date: Jan. 19, 2000

§ 102(e) Date: Jan. 19, 2000

(87) PCT Pub. No.: WO99/04977

PCT Pub. Date: Feb. 4, 1999

(30) Foreign Application Priority Data

Jul. 24, 1997 (DE) ..... 197 31 959

(51) Int. Cl.[7] ..... B41J 2/175; B65B 3/16; B65B 1/04

(52) U.S. Cl. ..... 347/85; 141/114; 141/351

(58) Field of Search ..... 347/85; 141/25, 141/114, 347, 351; 222/149, 527, 633

(56) References Cited

U.S. PATENT DOCUMENTS

| | | | | |
|---|---|---|---|---|
| 4,178,595 | | 12/1979 | Jinnai et al. . | |
| 4,187,511 | * | 2/1980 | Robinson | 347/85 |
| 4,677,448 | | 6/1987 | Mizasawa et al. . | |
| 5,136,305 | | 8/1992 | Ims . | |
| 5,199,470 | | 4/1993 | Goldman . | |
| 5,504,510 | * | 4/1996 | Miyakawa | 347/85 |
| 5,631,681 | * | 5/1997 | Klaus et al. | 347/85 |
| 5,742,308 | * | 4/1998 | Cowger et al. | 347/85 |
| 5,801,735 | * | 9/1998 | Lorenze, Jr. et al. | 347/85 |
| 5,912,687 | * | 6/1999 | Cowger et al. | 347/85 |
| 5,933,172 | * | 8/1999 | Park et al. | 347/85 |

FOREIGN PATENT DOCUMENTS 0 803 364 10/1997 (EP) .

OTHER PUBLICATIONS

Patent Abstracts of Japan, JP 08 112913, May 7, 1996.
Patent Abstracts of Japan, JP 08 300681 Matsushita Electric Ind Co. Ltd. Nov. 19, 1996.
Patent Abstracts of Japan, JP 07 125242 (Cannon Inc.), May 16, 1995.
Patent Abstracts of Japan, JP 54 061934 (Ricoh Co Ltd), May 18, 1979.
Patent Abstracts of Japan, JP 08 001959 (Canon Inc.), Jan. 9, 1996.

* cited by examiner

*Primary Examiner*—N. Le
*Assistant Examiner*—Judy Nguyen
(74) *Attorney, Agent, or Firm*—Schiff Hardin & Waite

(57) ABSTRACT

An ink jet printer has an ink filling device for an ink jet print head wherein the ink jet print head can be filled with the filling device. The ink filling device has an ink reservoir and a discharge opening. The print head has an ink chamber with a feed opening for ink and can be filled when it is installed in an ink jet printer. The discharge opening is arranged in a hollow body with a variable-volume that moves ink from the ink reservoir when the volume is increased and that discharges ink via the discharge opening when the volume is decreased.

8 Claims, 2 Drawing Sheets

Figure 1:
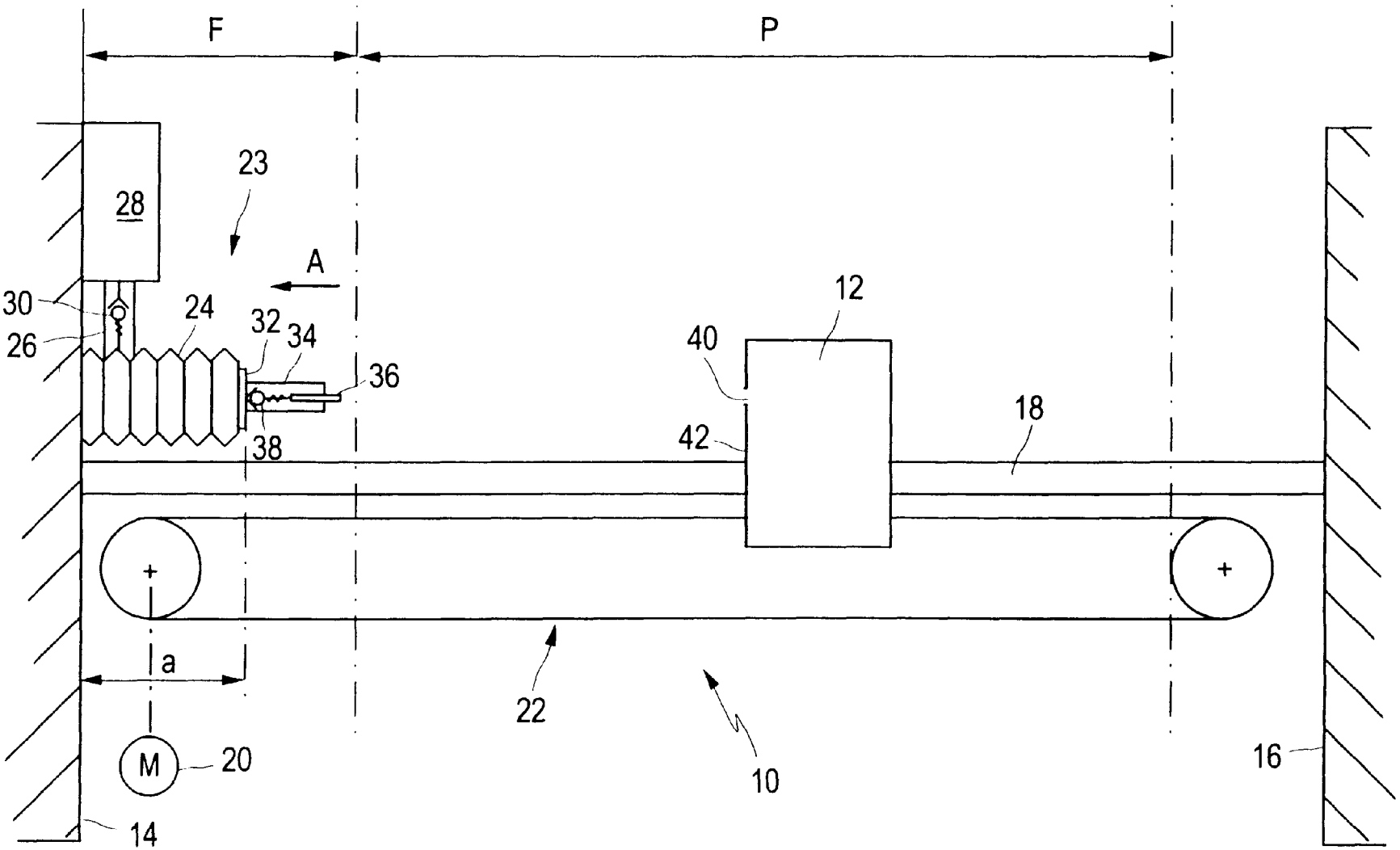

INK FILLING DEVICE FOR AN INK JET PRINT HEAD AND INK PRINT HEAD WHICH CAN BE FILLED THEREWITH

BACKGROUND OF THE INVENTION

The invention relates generally to print heads for ink jet printers. The invention relates more particularly to an ink jet printer having an ink jet print head which can be displaced in the direction of a line of print between side walls of a printer frame, and having an ink filling device for filling the ink jet print head.

Ink jet print heads have a limited ink supply, which is generally sufficient for printing about 1–4 million printed characters. In the case of ink jet printers which must be available day and night, on weekends and even during holiday periods, such as those in fax machines, for example, and in uses with a high permanent loading, such as in cash register printers, the ink supply stored in the ink jet print head is not sufficient.

It has therefore already been proposed, in Japanese Patent Document JP-A-90 29 991, to refill an ink jet print head while it is installed in an ink jet printer. For this purpose, the ink jet print head is equipped with level detectors, which detect its minimum and maximum permissible ink level. If the level falls below the minimum, the ink jet print head is transported with its feed opening underneath an ink refilling device where, with the aid of an electromagnet, a nozzle connected to an ink reservoir which is placed higher up is lowered into the feed opening and is lifted off the latter after the maximum level has been reached.

This arrangement ensures that the ink jet print head is always ready to print. On the other hand, the amount of ink transferred into the ink jet print head is determined by electrically controlled means and depends only on a level detector. If the voltage supply fails during a filling operation, or if the level detector fails, the ink flow from the ink reservoir cannot be interrupted.

U.S. Pat. No. 4,178,595 discloses an ink jet printer in which the ink jet print head is arranged such that it can be displaced in the direction of a line of print between side walls of the printer frame. The feed opening is arranged on one side wall of the ink jet print head, and a discharge opening of an ink filling device is arranged on one side wall of the printer frame, aligned coaxially with the feed opening. In this case, the feed opening can be connected to the discharge opening in a liquid-tight manner by displacement of the ink jet print head in the direction of a line of print toward the discharge opening.

The discharge opening of the ink filling device is fitted to a variable-volume cylinder which, when its volume is increased, removes ink from an ink reservoir and, when its volume is reduced, discharges ink through the discharge opening. The cylinder is dimensioned such that it picks up and discharges only a small amount of ink in each case. When its volume is reduced, a connecting line between the cylinder and the ink reservoir is closed, so that no ink can flow from the ink reservoir into the cylinder or back from the cylinder into the ink reservoir. The reduction in volume of the cylinder is carried out by a piston which can be displaced with the aid of an electromagnet, the increase in volume is carried out by a spring which pushes the piston back. The amount of ink to be transferred into the ink jet print head is determined by the period during which current is applied to the electromagnet.

The known ink filling device additionally needs an electromagnet and additional outlay on control for the electromagnetic. In addition, the electromagnet has to be of powerful design, since it has to produce the flow pressure for the ink, and has to overcome the friction of the piston in the cylinder and the restoring force of the spring.

SUMMARY OF THE INVENTION

One object of the present invention is to provide an ink jet printer having an ink filling device for an ink jet print head and an ink jet print head that can be filled therewith. Another object of the present invention is to provide such an ink jet printer and print head wherein only a specific amount of ink is transferred into the ink jet print head without requiring additional outlay for the drive system.

In meeting these and other objects, features and advantages of the present invention, an ink jet printer is provided having a print head which can be displaced in the direction of a line of print between sidewalls of a printer frame. The printer has an ink filling device by which the print head can be filled while it is installed in the ink jet printer. The filling device has an ink reservoir and a discharge opening. The print head has an ink chamber with a feed opening for receiving ink. The discharge opening is fitted to a variable-volume hollow body which, when its volume it increased, removes ink from the ink reservoir and, when its volume is reduced, discharges ink through the discharge opening. The feed opening is arranged on one sidewall of the print head and the discharge opening is arranged on one sidewall of the printer frame and is aligned coaxially with the feed opening. The feed opening can be connected to the discharge opening in a liquid-tight manner by displacement of the ink jet print head in the direction of a line of print toward the discharge opening. The hollow body is arranged on the inside of the sidewall of the printer frame. The reduction in volume is performed by a further displacement of the print head toward the sidewall beyond the point where the feed opening of the print head is connected to the discharge opening. An increase in volume is carried out by a displacement of the print head in the opposite direction with the existing connection between the feed opening and the discharge opening.

The invention is based on the idea that the drive motor, which is needed in any case to displace the ink jet print head between the side walls of the ink jet printer along the line of print, can be used to influence the volume of the hollow body, if the hollow body is arranged on the side wall of the printer frame. The same drive motor is used for docking the ink jet print head with the discharge opening. The reduction in volume is then carried out by further displacement of the ink jet print head toward the side wall, beyond the point at which the feed opening of the ink jet print head is connected to the discharge opening. An increase in volume is carried out by displacing the ink jet print head in the opposite direction. Therefore, the drive motor needed to displace the print head along the line of print, preferably a stepping motor, can also be used to influence the volume of the hollow body, with the effect of triple use. This means that no additional drive elements are necessary.

The arrangement according to the invention has the advantage that only a well-metered volume of ink can pass to the ink jet print head. With regards to the flow of ink, the arrangement has an inherently safe operating state during every operating state of the ink jet printer. Only when the hollow body is being acted on with the effect of reducing its volume is the discharge opening opened. When the volume is constant or when the volume of the hollow body is being increased, the discharge opening is securely closed, so that no ink can flow out.

In an advantageous development of the invention, the amount of ink discharged from the ink filling device to the ink jet print head is determined by the magnitude of the adjustment or the further displacement. As a result, even ink jet print heads which have been partly emptied can be filled with the necessary amount of ink, and the use of ink jet print heads having different holding capacities is possible without changing the arrangement. The hollow body is then only partially emptied. As its volume is increased, its filling is also then only carried out in accordance with the amount of ink removed.

According to a further development of the invention, the time and/or the amount of ink of an ink fill can be controlled on the basis of a prescribable number of printed dots or printed characters that are printed. This is because the ink jet print head was inserted into the ink jet printer and, after that, the printed points or printed characters printed since the last ink fill. Since the ink droplets ejected by the pressure nozzles of the ink jet print head have a known volume, the consumption of ink can be calculated from the number of nozzles respectively activated during printing. This applies in a similar way to the number of printed characters, if the average consumption of ink for these is known. Refilling the ink jet print head with an amount of ink corresponding to the calculated consumption thus becomes readily possible. The time of a refilling can also be determined in this way.

In order to permit the flushing of blocked nozzles, the reduction in volume and the increase in volume can be carried out many times immediately one after another. This process can be triggered automatically by the printer control system itself by means of a specific control command to the ink jet printer or on the basis of the operating time of the ink jet print head.

The discharge opening is formed on a tubular connecting piece which, when the ink jet print head is displaced toward the discharge opening, penetrates into the feed opening of the ink jet print head. Built into the connecting piece is a valve which is spring-loaded into its closed position and which opens when the pressure in the hollow body exceeds a prescribed value. The arrangement of the connecting piece on the hollow body has the advantage that when the displacement movement of the ink jet print head toward the discharge opening and therefore toward the hollow body is completed, the pressure in the latter immediately falls below the prescribed value and the valve closes. When the ink jet print head is displaced away from the hollow body, the connecting piece initially remains still connected to the feed opening, but in the area in front of the valve a negative pressure is formed, which ensures that the ink still remaining in this area is sucked into the ink jet print head.

The variable-volume hollow body may optionally be constructed as a compressible balloon made of resilient plastic, as a bellows or else as a piston/cylinder arrangement.

BRIEF DESCRIPTION OF THE DRAWING FIGURES

Figure 3:
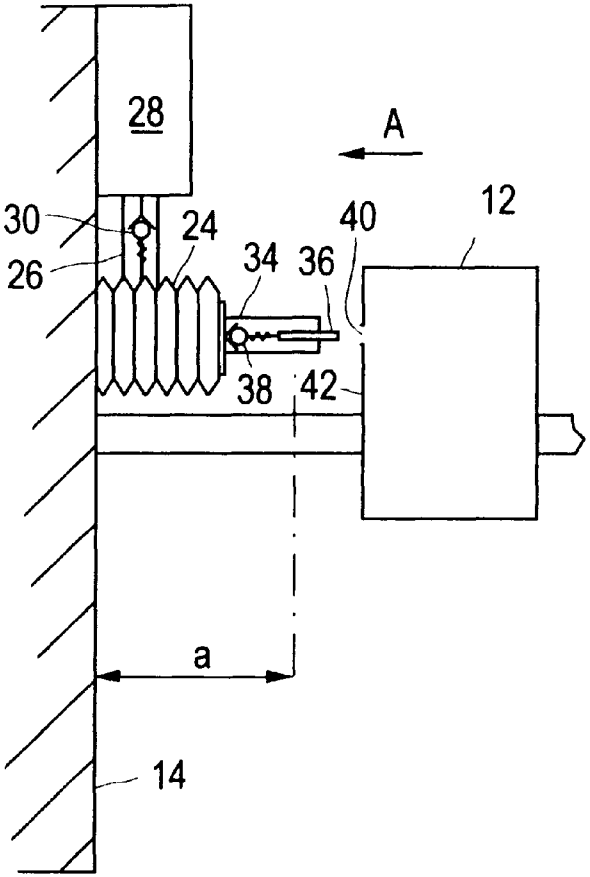
Figure 2:
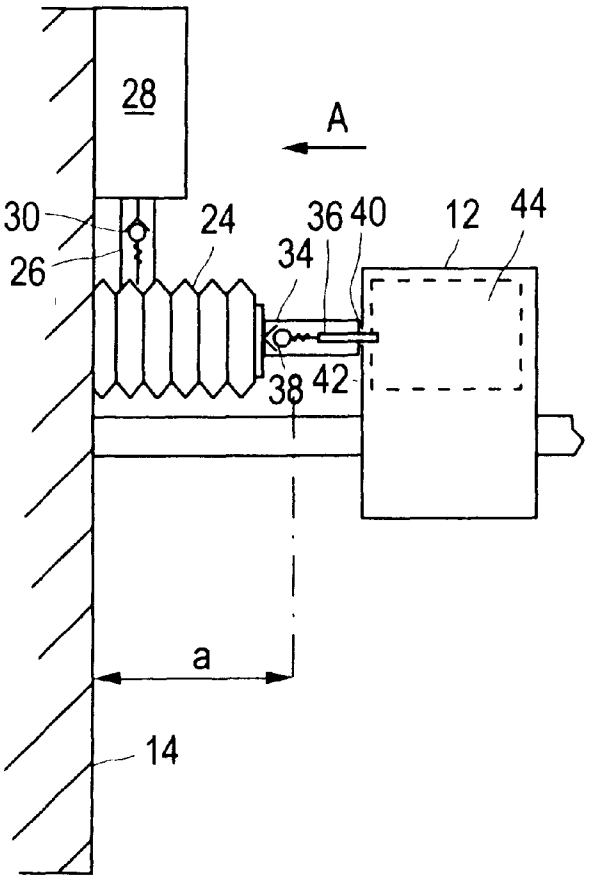

The invention will be explained below using an exemplary embodiment in conjunction with the appended drawings, in which FIG. 1 illustrates a schematic front view of an ink jet printer constructed in accordance with one embodiment of the present invention;

FIG. 2 illustrates a portion of the ink jet printer of FIG. 1 wherein the print head is shown moved toward the discharge opening connecting the feed opening and the discharge opening and collapsing the hollow body; and FIG. 3 illustrates the portion of the ink jet printer of FIG. 1 wherein the print head is moved in the opposite direction away from the discharge opening and prior to the hollow body increasing in volume.

FIG. 1 shows an ink jet printer, designated generally by 10, in a schematic front view. An ink jet print head 12 is guided such that it can be displaced in both directions along a line of print on a parallel guide 18 between a left side wall 14 and a right side wall 16 of a printer frame. The ink jet print head 12 is displaced by a belt mechanism 22 which can be driven by a stepping motor 20. The ink jet printer 10 has a printing area P, which can be occupied at most by a recording medium. On the left in FIG. 1, the printing area P is adjoined by an ink filling area F, in which there is an ink filling device designated overall by 23.

The ink filling device 23 has a bellows 24 fastened to the inside of the left side wall 14. The bellows is acted on, as a result of its inherent elasticity, by a restoring force acting in the direction of its maximum longitudinal extent a. The bellows 24 can be compressed in the direction of arrow A, counter to its restoring force, parallel to the line of print. A connecting line 26, whose other end is connected to an ink reservoir 28, opens into the bellows 24. Built into the connecting line 26 is a first valve 30, which is spring-loaded into its closed position. This valve opens when the pressure in the bellows 24 is lower by a prescribed value than the pressure in the ink reservoir 28.

Fitted perpendicular to the end face 32 of the bellows 24 facing the ink jet print head 12 is a tubular connecting piece 34, which is extended in a nozzle-like discharge opening 36. Built into the connecting piece 34 is a second valve 38, which is spring-loaded into its closed position. This valve opens when the pressure in the bellows 24 exceeds a prescribed value. The discharge opening 36 is arranged to be aligned coaxially with a feed opening 40, which is made in a side wall 42 of the ink jet print head 12 facing the ink filling device 23.

The feed opening 40 can be connected to the discharge opening 36 in a liquid-tight manner by displacement of the ink jet print head 12 in the direction of arrow A toward the discharge opening. This operating state of the ink jet printer 10 is illustrated in FIG. 2, the bellows 24 already having been compressed to a small extent with respect to its maximum length a. The ink in the bellows 24 is therefore under a pressure which has been increased to such an extent that the first valve 30 is closed and the second valve 38 is open. If the ink jet print head 12 is moved further in the direction of the arrow A, the bellows 24 is compressed to an increasing extent, and the ink flows through the discharge opening 36 and the feed opening 40 into an ink chamber 44 in the ink jet print head 12. As a result of the discharge of ink, the pressure in the bellows 24 decreases to such an extent that the second valve 38 closes.

FIG. 3 shows this operating state, the ink jet print head 12 already having been moved away from the left side wall 14 to a small extent counter to the direction of the arrow A. At this moment, the bellows 24 begins to expand again, so that a negative pressure is produced in it. This negative pressure opens the first valve 30, so that ink can flow out of the ink reservoir 28 into the bellows 24. This operating state is illustrated in FIG. 1.

What is claimed is:

1. An ink jet printer, comprising:

an ink jet print head which can be displaced in a direction of a line of print between sidewalls of a printer frame, the print head having an ink chamber therein with a feed opening for receiving ink, the feed opening arranged on a one sidewall of the print head;

an ink filling device that can fill the pint head while the printer head is installed in the ink jet printer, wherein the filing device has an ink reservoir and a discharge opening arranged on one sidewall of the printer frame and aligned coaxially with the feed opening, where the feed opening can be connected to the discharge opening in a liquid-tight manner by displacement of the print head in the direction of a line of printer toward the discharge opening; and a variable-volume hollow body arranged at the one sidewall of the printer frame and fitted to the discharge opening and the ink reservoir, wherein when the volume of the hollow body is increased, ink is removed from the reservoir into the hollow body and, when the volume of the hollow body is reduced, ink from the hollow body is discharged through the discharge opening and wherein volume reduction of the hollow body is performed by a further displacement of the print head toward the one sidewall beyond a point where the feed opening of the print head is initially connected to the discharge opening, and a volume increase is achieved by a displacement of the print head in the opposite direction with the existing connection between the feed opening and the discharge opening.

2. The ink jet printer according to claim 1, wherein the amount of ink discharged from the ink filing device to the ink jet print head is determined by the magnitude of the further displacement.

3. The ink jet printer according to claim 1, wherein a number of printed dots or printed characters that are printed since the ink jet print head was inserted into the ink jet printer and, after that, the printed dots or printed characters printed since the last ink fill is registered, and the time and/or the amount of ink of an ink fill is controlled on the basis of a prescribable number of printed dots or printed characters.

4. The ink jet printer according to claim 1, wherein the reduction in volume and the increase in volume of the hollow body can be carried out many times immediately one after another.

5. The ink jet printer according to claim 1, wherein the discharge opening is formed on a tubular connecting piece which, when the ink jet print head is displaced toward the side wall, penetrates into the feed opening of the ink jet print head, and a valve is built into the connecting piece which is spring-loaded into its closed position and which opens when the pressure in the hollow body exceeds a prescribed value as a result of its reduction in volume.

6. The ink jet printer according to claim 1, wherein the variable-volume hollow body is a compressible balloon made of resilient plastic.

7. The ink jet printer according to claim 1, wherein the variable-volume hollow body is a bellows.

8. The ink jet printer according to claim 1, wherein the variable-volume hollow body is a piston and cylinder arrangement.

* * * * *

UNITED STATES PATENT AND TRADEMARK OFFICE

CERTIFICATE OF CORRECTION

PATENT NO. : 6,199,975 B1
DATED : March 13, 2001
INVENTOR(S) : Günter Baitz et al.

It is certified that error appears in the above-identified patent and that said Letters Patent is hereby corrected as shown below:

Title page,
Item [73], correct "Aderborn" to read -- Paderborn --.

Signed and Sealed this

Sixth Day of November, 2001

*Attest:*

Nicholas P. Godici

*Attesting Officer*

NICHOLAS P. GODICI
*Acting Director of the United States Patent and Trademark Office*